US012698019B2

(12) United States Patent
Vrba et al.

(10) Patent No.: US 12,698,019 B2
(45) Date of Patent: Aug. 4, 2026

(54) SYSTEM AND METHOD TO DETERMINE A LOCATION OF A DESIGNATED POSITION OF A VEHICLE SYSTEM

(71) Applicant: Transportation IP Holdings, LLC, Norwalk, CT (US)

(72) Inventors: Matthew Vrba, Marion, IA (US); Stephen Craven, Hiawatha, IA (US); Amit Saxena, Marion, IA (US); Keith Edward Smith, Cedar Rapids, IA (US); Rebekkah Linker, Cedar Rapids, IA (US); Katrina Aileen See, Cedar Rapids, IA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 0 days.

(21) Appl. No.: 18/821,282

(22) Filed: Aug. 30, 2024

(65) Prior Publication Data

US 2025/0074485 A1 Mar. 6, 2025

Related U.S. Application Data

(60) Provisional application No. 63/579,685, filed on Aug. 30, 2023.

(51) Int. Cl.
*B61L 25/02* (2006.01)

(52) U.S. Cl.
CPC ..... *B61L 25/025* (2013.01); *B61L 2205/04* (2013.01)

(58) Field of Classification Search
CPC .. B61L 25/025; B61L 25/026; B61L 2205/04; B61L 15/0072
See application file for complete search history.

(56) References Cited

U.S. PATENT DOCUMENTS

| | | | | |
|---|---|---|---|---|
| 5,403,238 | A | 4/1995 | Baxter et al. | |
| 2009/0063036 | A1* | 3/2009 | King | A63G 7/00 701/408 |
| 2020/0207386 | A1* | 7/2020 | Chan | B61L 15/0045 |
| 2021/0139053 | A1* | 5/2021 | Tokumaru | B61L 27/04 |
| 2022/0315074 | A1* | 10/2022 | Mathur | B61L 27/40 |
| 2024/0071214 | A1* | 2/2024 | Saxena | G08G 1/0145 |
| 2025/0074485 | A1* | 3/2025 | Vrba | B61L 25/026 |

OTHER PUBLICATIONS

Search Report for corresponding France Application No. 2409300, dated Dec. 15, 2025.

* cited by examiner

*Primary Examiner* — George C Jin
(74) *Attorney, Agent, or Firm* — K&L Gates LLP

(57) ABSTRACT

A method is provided including obtaining a first range area in which a designated position of a vehicle system may be determined to be located based at least in part on a calculated distance from a known location at a front end of the vehicle system that has been determined by a leading sensor. The front end may be relative to a direction of travel. The method may include obtaining a second range area in which the designated position of the vehicle system may be determined to be located using a different, trailing sensor that is located spaced away from the front end of the vehicle system. The method may include determining a degree of overlap, or lack of overlap, of the first range area and the second range area and responding to a determined degree of overlap.

15 Claims, 6 Drawing Sheets

SYSTEM AND METHOD TO DETERMINE A LOCATION OF A DESIGNATED POSITION OF A VEHICLE SYSTEM

BACKGROUND

Technical Field

Examples of the subject matter herein relate to methods and systems for determining a location of a designated position in or on a vehicle system.

Discussion of Art

Vehicle systems (for example, rail vehicle systems or other vehicle systems that do not travel on rails or tracks) can be formed from a single vehicle or multiple vehicles. With respect to multi-vehicle systems, the vehicles can be mechanically coupled with each other (e.g., by couplers) or logically coupled but not mechanically coupled. Where vehicle systems may be made up of multiple vehicles, it may be necessary to determine a location of a front end of the vehicle system, a rear end of the vehicle system, as well as portions of the vehicle system between the front end and the rear end.

Current vehicle systems may include a computer system onboard the front end of the vehicle system. The computer system may provide safety, navigational, and other functions for the vehicle system. To perform these functions, it may be helpful to determine a location of the rear end. Currently, the location of the rear end of the vehicle system may be determined based on taking a location associated with the head end location of the vehicle and tracing a known route of the vehicle back to a distance specified by a length of the vehicle system, as specified by personnel of the vehicle system, for example. The location of the head end of the vehicle may be determined using a global navigation satellite system (GNSS) receiver.

Many current systems may only use this single source of data to determine the rear end location of the vehicle system. As such, when making safety impacting decisions, current systems may factor in a safety uncertainty margin further behind the rear end of the vehicle system where the actual rear end of the vehicle system may exist based on errors in data used to determine the rear end location. The safety margin may account for errors in the head end position that may be the result of inaccuracies in the GNSS determination of the location of the rear end of the vehicle system. However, the safety margin may not account for other sources of error, for example human error when entering vehicle system length, normal vehicle dynamics such as compression and stretching between vehicles, errors in a track database, or the like. Current systems may not be able to properly account for these sources of error without being impractically large because there is not another source of information about the location of the rear end of the vehicle system. As a result, current systems may not be able to accurately and/or precisely determine the rear end location of the vehicle system with a high enough confidence to perform safety functions (e.g., to prevent another vehicle from colliding with the rear end of the vehicle system, to ensure that the rear end of the vehicle system is clear of a crossing, intersection, or switch; etc.), and may require involvement of personnel of the vehicle system to confirm the rear end location of the vehicle system. It may be desirable to have a system and method that differs from those that are currently available.

BRIEF DESCRIPTION

In accordance with one example or aspect, a method is provided that includes obtaining a first range area in which a designated position (e.g., a rear end) of a vehicle system may be determined to be located based at least in part on a calculated distance from a known location at a front end of the vehicle system that has been determined by a leading sensor. The front end may be relative to a direction of travel. The method may include obtaining a second range area in which the designated position of the vehicle system may be determined to be located using a different, trailing sensor that may be located spaced away from the front end of the vehicle system. The method may include determining a degree of overlap, or lack of overlap, of the first range area and the second range area and responding to a determined degree of overlap.

In accordance with another example or aspect, a system is provided that includes a first sensor, a second sensor, and a controller having one or more processors. The first sensor may sense a location of a reference position of a vehicle system. The processors may calculate a first range area in which a designated position of the vehicle system may be determined to be located based at least in part on a calculated distance from the location of the reference position determined by the first sensor. The second sensor may sense a second range area in which the designated position of the vehicle system may be determined to be located. The controller may compare the first range area and the second range area and may respond to an overlap or a lack of overlap of the first range area and the second range area.

In accordance with one example or aspect, a method is provided that includes sensing a forward or first location of a first vehicle system using a first or leading sensor. The method may include adding a designated distance to the forward or first location to identify a calculated range of locations of a designated position of the first vehicle system. The method may include obtaining a sensed location of the designated position of the first vehicle system using a trailing or second sensor. The method may include comparing the calculated range of potential locations of the designated position with an uncertainty range of the sensed location of the designated position to determine whether the sensed location of the designated position and the calculated range of potential locations of the designated position overlap or are within a threshold distance of each other. The method may include identifying a safety boundary at or within a rearward most of the calculated range and the uncertainty range responsive to the calculated range and the uncertainty range overlapping each other or being within the threshold distance of each other or identifying the safety boundary at or within the calculated range responsive to the calculated range and the uncertainty range not overlapping and not being within the threshold distance of each other.

BRIEF DESCRIPTION OF THE DRAWINGS

The subject matter may be understood from reading the following description of non-limiting examples, with reference to the attached drawings, wherein below.

DETAILED DESCRIPTION

Embodiments of the subject matter described herein may relate to methods and systems for determining a location of a designated position (e.g., a rear end position) of a vehicle system. The methods and systems may use more than one source of information in the determination or calculation of the location of the designated position (or another position) of the vehicle system. The methods and systems may increase the confidence and reliability in determining where different positions of the vehicle system are located. This can increase the safety of operating the vehicle system as having more accurate locations (e.g., geographic locations) of different positions (e.g., a rear or trailing end or the last vehicle in a vehicle convoy) of the vehicle system can help ensure that other vehicles do not collide with the vehicle system, that the vehicle system is clear of an intersection, crossing, gate, or switch; and the like. While one or more embodiments or examples described herein relate to determining locations of the rear end of a mechanically coupled vehicle system, not all embodiments or examples may be limited to determining the locations of this position. Other embodiments or examples may relate to determining a position in a vehicle system other than the rear end, such as a position that is several feet from the rear end, a middle position, a front position, or the like, in the vehicle system. Other embodiments may further include a vehicle, in a vehicle group, that is distant from the lead or first vehicle.

The vehicles and vehicle systems described herein extend to multiple types of vehicles or vehicle systems. Suitable vehicle types may include automobiles, trucks (with or without trailers), rail vehicles or rail vehicle systems, buses, marine vessels, aircraft, mining vehicles, agricultural vehicles, or other off-highway vehicles. The vehicle systems described herein (rail vehicle systems or other vehicle systems that do not travel on rails or tracks) can be formed from a single vehicle or multiple vehicles. With respect to multi-vehicle systems, the vehicles can be mechanically coupled with each other (e.g., by couplers) or logically coupled but not mechanically coupled. For example, vehicles may be logically but not mechanically coupled when the separate vehicles communicate with each other to coordinate movements of the vehicles with each other so that the vehicles travel together as a group. Vehicle systems may also be referred to as vehicle groups, convoys, consists, swarms, fleets, platoons, trains, etc.

Figure 1:
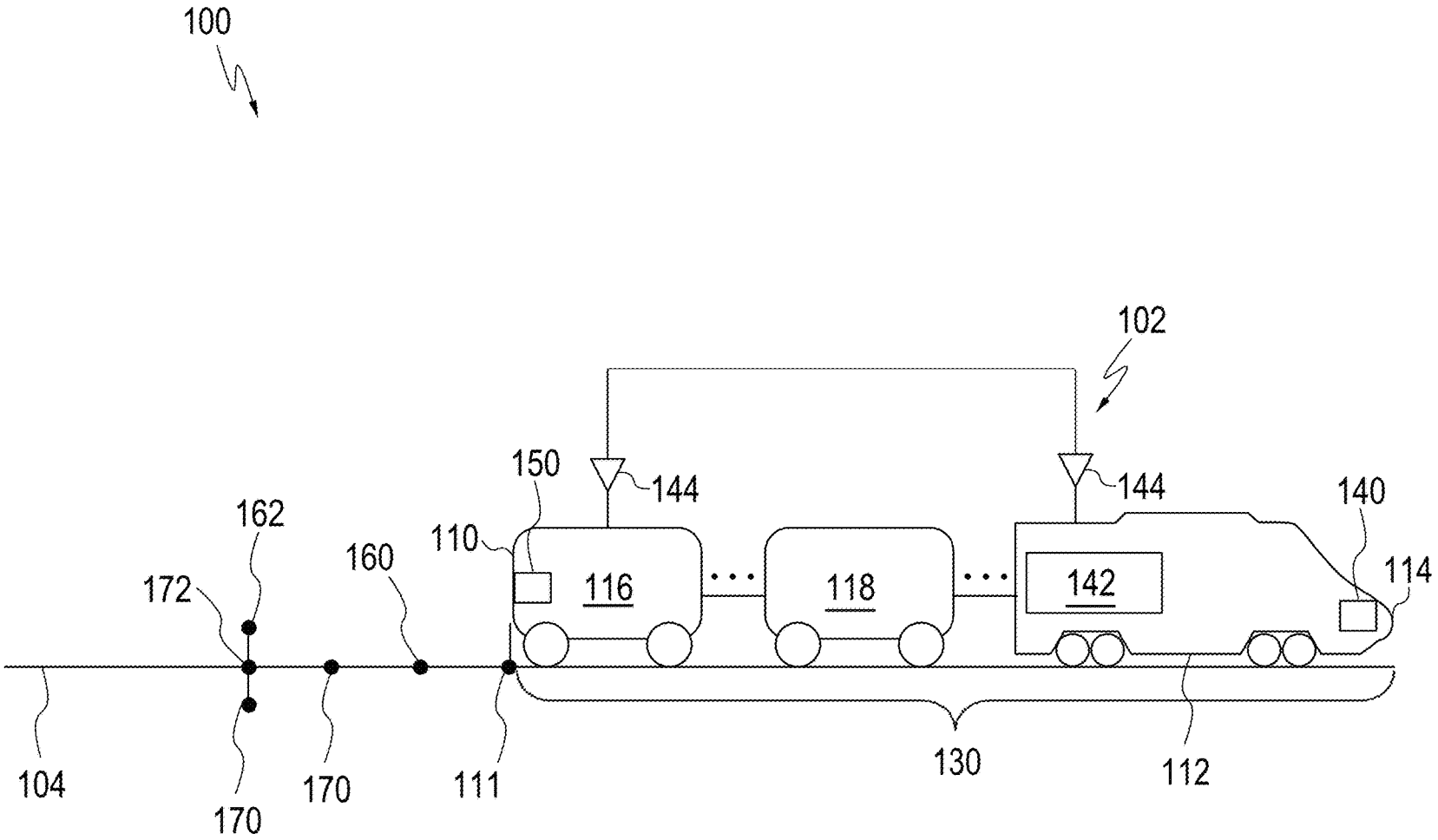
FIG. 1 illustrates one example of a location determining system that can determine a location of a designated position of a vehicle system.

FIG. 1 illustrates one example of a location determining system 100 that can determine a location of a designated position 110 of a vehicle system 102. The vehicle system may travel along a route 104. The vehicle system may include, for example, a lead vehicle 112 at a front end 114 of the vehicle system, a trailing vehicle 116 at a rear end of the vehicle system, and/or one or more intermediate vehicles 118 between the lead vehicle and the trailing vehicle. Optionally, the vehicle system may only include the lead vehicle and the trailing vehicle or just the lead vehicle. As used herein, the front end of the vehicle may be a forwardmost portion of the vehicle. However, the front end may be in a forward half of the vehicle, without being a forwardmost portion (e.g., the front end may be closer to the leading end of the vehicle system than the opposite end of the vehicle system). Similarly, the rear end of the vehicle may be a rearward most portion of the vehicle. However, the rear end may be in a rear half of the vehicle, without being a rearward most portion (e.g., the rear end may be closer to the trailing end of the vehicle system than the opposite end of the vehicle system).

The location of the designated position that is determined may be a geocode, such as a geographic coordinate (e.g., a longitude, latitude, and/or elevation), Universal Transverse Mercator (UTM) coordinates, Military Grid Reference System (MGRS) coordinates, or another grid location. The location of the designated position may be an absolute location (e.g., a precise and specific geographic location of a particular place on, above, or below the surface of the Earth that provides an exact point of reference for locating the designated position on the planet). Optionally, the location may be a relative location, such as a location that is a calculated distance away from another location.

The vehicle system may include a controller 142. The controller may have hardware circuitry that may include and/or may be connected with one or more processors (e.g., one or more microprocessors, integrated circuits, microcontrollers, field programmable gate arrays, etc.). The controller may represent one or more control units or devices that may be operably connected to perform the operations described herein. In an embodiment, the one or more processors may be disposed in a single, unitary control unit or controller. In another embodiment, the controller may include multiple different control units, and the processors may be distributed among the control units. The controller may include and/or may be connected with a tangible and non-transitory computer-readable storage medium (e.g., data storage device), referred to herein as memory. The memory may store program instructions (e.g., software) that are executed by the controller's one or more processors to perform the operations described herein. The program instructions may include one or more algorithms utilized by the controller's one or more processors to generate one or more outputs. In one example, the controller's one or more processors may implement machine learning or artificial intelligence (AI) systems to generate the one or more outputs. The program instructions may provide functions, models, and/or neural networks used to generate the outputs. The program instructions may further dictate actions to be performed by a controller having one or more processors. While the controller shown in FIG. 1 may be shown within the vehicle system, in other examples the controller may be remote from the vehicle system.

In one example, the controller may include an on-board computer. The on-board computer may be a part of a positive vehicle control (PVC) system. In one example, the controller may be separate from the PVC system. The PVC system may be a subsystem on the vehicle system that may communicate with an off-board PVC system. The controller may communicate with the PVC system. A PVC system may be a control system in which a vehicle system may be allowed to move, and/or may be allowed to move outside a designated restricted manner (such as above a designated penalty speed limit), only responsive to receipt or continued receipt of one or more signals (e.g., received from off-board the vehicle) that meet designated criteria, e.g., the signals have designated characteristics (e.g., a designated waveform and/or content) and/or are received at designated times (or according to other designated time criteria) and/or under designated conditions. The PVC system may include information about the route or the vehicle system, for example, a projected trip plan, a route database, a length of the route, a grade of the route, a curvature of the route, a number of vehicles in the vehicle system, a length of the vehicle system, a speed of the vehicle system, a type of vehicle in the vehicle system, a weight of the vehicle system, or the like. In one example, the on-board computer may include a Negative Vehicle Control (NVC) system. The NVC may allow a vehicle to move unless a signal (restricting movement) may be received.

The system may determine a length 130 of the vehicle system. In one example, the length may be calculated by summing the lengths of the vehicles and estimated space(s) between vehicles. The length may be summed in a direction of movement of the vehicle system. Optionally, the length may be determined or input by an operator or other crew member of the vehicle system, may be obtained from one or more sensors, may be received from one or more control systems, may be obtained from a vehicle database, may be learned from a vehicle manifest, or the like. Optionally, the length can be a default value or distance. In one example, the length of the vehicle system may be determined by measuring a distance between the front end and the rear end of the vehicle system. In one embodiment, a network level vehicle coordination and management system may use the location data to ensure that a determined block portion of a route is clear of a first vehicle before allowing another vehicle to enter the block.

The system may include one or more sensors. A leading sensor 140 may be positioned at a reference position, for example on the lead vehicle. In one example, the leading sensor may be positioned on another vehicle of the vehicle system. The leading sensor may include a navigation system or positioning system, for example a GNSS receiver such as a global positioning system (GPS) receiver, a dead reckoning mechanism using a wheel tachometer or other speed sensor, another wireless triangulation system, an inertial measurement unit which may include a digital accelerometer and gyroscope, or the like. The leading sensor may output data to the controller and the controller may use the output to calculate a location of the reference position of the vehicle system or the leading sensor itself may determine this location. This location may be or may include a geographic coordinate (e.g., longitude, latitude, and/or altitude or elevation) or a location expressed on another grid. The location may be an absolute location (e.g., a geographic coordinate or a coordinate on another system) or a relative location (e.g., a distance from a designated location).

In one example, the leading sensor may include another positioning system, for example a proximity sensor that may determine or assist in the determination of the location by detecting the presence of a target along the route and indicating the location where the target was read as the location. As another example, the leading sensor may be or may include an optical sensor (e.g., an infrared sensor, a camera, a proximity detector, etc.) that may scan, read, or otherwise identify an identifying marker. This identifying marker can be indicia printed on a sign, wayside device, building, signal, gate, or the like. The identifying marker may be associated with a location along the route. When the optical sensor may scan or read the identifying marker, the location of the identifying marker may be used as the location of the optical sensor.

The controller may calculate a location 111 of the designated position of the vehicle system by taking the location of the leading sensor and tracing the known route (e.g., a length of the route, an elevation of the route, a curve of the route, etc.) of the vehicle system back to a distance specified as the vehicle system length. The controller may use inputs from the PVC system to trace the route back to the distance specified as the vehicle system length. In another example, the controller may use inputs from an operator or another control system to trace the route back to the distance specified as the vehicle system length. In one example, route information (e.g., the length, grade, shape, contour, elevation, etc.) may be output to the controller by the PVC system. In other examples, the route information may be determined by one or more sensors, one or more databases, or the like. The vehicle system length may be output to the controller by the PVC system, by an operator, or by a crew member of the vehicle system. In other examples, the vehicle system length may be determined from output from one or more sensors, one or more databases, or the like.

The location of the leading sensor may be an absolute location and/or a relative location of the leading sensor. The absolute location may be a geographic coordinate of the reference position, for example the front end of the vehicle system.

The location of the leading sensor may be based on a relative location. The relative location may be determined based on a proximity of the leading sensor to the route or a proximity of the leading sensor to a portion the route such as a route block. A given route may be made up of multiple route blocks. The route blocks may be divided the route into smaller portions, where each route block may have a known location that may be included in the route database. In one example, an identification of the route and route block may be stored in the route database and may be accessible by the vehicle system, or operators or components thereof. An identification of locations along the route and route block may be stored in the route database. The route block may include wayside devices, for example a switch including a marker (e.g., a QR code or a label) that may be read by the leading sensor. For example, the leading sensor may be a proximity sensor that may read and identify the marker in the wayside device when the leading sensor is within a predetermined distance from the marker. When the leading sensor reads the marker of the wayside device, the leading sensor may communicate the marker of the wayside device to the controller of the vehicle system. The marker of the wayside device may have a location that may be stored in the route database. The controller or the leading sensor can obtain this location of the wayside device from the database using the marker that is identified. The leading sensor may communicate a signal indicating the identification of the marker of the wayside device directly to the controller. The controller may use the location information associated with the marker stored in the route database to determine the location of the marker. The controller may use the location of the marker as the location of the reference position of the vehicle system.

In one example, the leading sensor may communicate the determined location of the reference position to the controller via a communication device 144. However, in one example, the leading sensor may communicate directly with the controller. The communication device may communicate with one or more other vehicle systems and/or other remote systems that are off-board the vehicle system, such as an off-board controller, a back office control system, an off-board crew member, or the like. The off-board controller may get updates on the location of the vehicle system and may communicate the location to other vehicle systems. The communication device may include or represent an antenna (along with associated transceiver hardware circuitry and/or software applications) for wirelessly communicating with other vehicle systems and/or remote locations. Optionally, the communication device may communicate via one or more wired connections, such as a multiple unit (MU) cable, a trainline, an electrically controlled pneumatic (ECP) brake line, or the like.

The controller may incorporate an uncertainty margin 160 into the calculation of the location of the designated position of the vehicle system. The uncertainty margin may represent an error margin in the location of the designated position that is calculated. This uncertainty margin can indicate various different spaces where the designated position may actually be located (where the calculated location is inaccurate or imprecise). In one example, the uncertainty margin may be one distinct point. In another example, the uncertainty margin may be two or more points, making up a range of uncertainty. For example, the uncertainty margin may be a distance, such as 10 meters, 15 meters, 100 meters, or the like. The range of uncertainty may be a space between the two or more points, an area that encompasses the two or more points, a volume that encompasses the two or more points, or the like. In one example, the uncertainty margin may be expressed as a percentage that may be a confidence level of the calculation of the location of the designated position. The uncertainty margin may be determined as an estimated error standard deviation for each geographic location reported. The uncertainty margin may be calculated by the controller and may account for potential errors (e.g., sensor accuracy errors) in the inputs (e.g., the locations determined) from the leading sensor. The uncertainty margin may be based on the accuracy of the GNSS location.

In one example, the uncertainty margin may be located behind the calculated location of the designated position of the vehicle system along a direction of movement of the vehicle system. For example, the uncertainty margin may extend farther behind the designated position the vehicle system. This can allow the uncertainty margin to be communicated to the off-board control system and used as a barrier or boundary to prevent other vehicles or other vehicle systems from coming too close and colliding with the rear end of the vehicle system. Optionally, the uncertainty margin can be used to ensure that the designated position of the vehicle system has cleared or is no longer located in a crossing, intersection, switch, gate, or the like. In one example, the uncertainty margin may be in front of the calculated location of the designated position along a direction of movement of the vehicle system.

The errors used to determine the uncertainty may include errors in the accuracy of the leading sensor, for example an accuracy error margin of the GNSS location. The errors may also include errors in determining the length of the vehicle system, the length and/or curvature of the route, or the like.

In one example, the uncertainty margin may be a default value. The default value may be determined based on historical data indicating an uncertainty of historical locations determined for the designated position of the vehicle system compared with actual locations of the designated position of the vehicle system. Where the historical locations may vary widely from the actual locations or the historical locations may have large errors associated, the uncertainty margin may be larger. Where the historical locations may vary less widely from the actual locations or may have smaller errors associated, the forward and rearward location uncertainty may be smaller. The default values of the forward and rearward location uncertainty may be determined based on a formula derived based on the historical data.

In one example, the uncertainty margin may be manually input by a crew member of the vehicle system. In one example, the uncertainty margin may be calculated based on a speed of the vehicle system. In one example, when the speed of the vehicle system is faster, the uncertainty margin may be larger. When the speed of the vehicle system is slower, the uncertainty margin may be smaller. This may be the result of the changes in the measured locations of the designated position changing more rapidly during fast movement, which can result in greater uncertainty in measuring the geographic location of the designated location (when compared with moving more slowly).

Another source of uncertainty when determining the location of the designated position based on the leading sensor may be vehicle dynamic uncertainty. The vehicle dynamic uncertainty may be variances in the length of the vehicle system that may be used to calculate the location of the designated position from the measured location of the leading sensor. The vehicle dynamic uncertainty may be changes in the length of the vehicle system due to movement allowed between vehicle couplers, for example stretching or bunching. The vehicle dynamic uncertainty may increase, or change opposite the direction of movement, when the vehicles of the vehicle system may be stretching away from each other. The vehicle dynamic uncertainty may decrease, or change in the direction of movement, when the vehicles of the vehicle system may be bunching toward each other. The vehicle dynamic uncertainty may estimate an average distance between vehicles of the vehicle system.

In one example, the estimated distance between vehicles may be between 6 inches and 75 inches. The average distance between vehicles may be multiplied by the number of vehicles in the vehicle system. This may provide an estimate of a total distance or length between the vehicles of the vehicle system. In one example, the vehicle system may be instructed to be operated in a compression mode in order to reduce the gaps between adjacent vehicles of the vehicle system. In one example, the vehicle system may be instructed to be operated in a stretch mode in order to increase the gaps between adjacent vehicles of the vehicle system. The controller may receive the operation mode of the vehicle system (e.g., compression, stretch, etc.) and may modify the calculated location of the designated position based on the mode of operation. Vehicle dynamics may change during a trip, so it may be useful to use the vehicle dynamic uncertainty. The vehicle dynamic uncertainty may provide a range based on whether the vehicle may, for example, be in a fully compressed or a fully stretched position. By determining the vehicle dynamic uncertainty, the length of the vehicle system may be more accurately estimated, and thus, the controller may be able to more accurately calculate the location of the designated position.

The vehicle dynamic uncertainty may be calculated as a predetermined percentage of the overall vehicle system length. For example, the vehicle dynamic uncertainty may be between 0.3% and 5% of the overall vehicle system length. The vehicle dynamic uncertainty may be validated when the vehicle system is stopped to ensure that the vehicle system length has not changed by more than the predetermined percentage of the overall vehicle system length. When the vehicle system may be stopped, the length may be measured by the one or more sensors. This measurement and validation when the vehicle system may be stopped may increase the confidence in the vehicle dynamic uncertainty during movement of the vehicle system.

In one example, the uncertainty margin may be calculated or measured by the controller by looking at inter-vehicle spacing (e.g., distances between vehicles). The inter-vehicle spacing may be measured or calculated using sensors that may measure the distance between vehicles, default values based on the number of vehicles of the vehicle system, types of couplers, route and vehicle characteristics (e.g., the curve of the route, the speed of the vehicle system, bunching/stretching of the vehicle system, or the like). The controller may use the vehicle dynamic uncertainty in calculating the location of the designated position of the vehicle system. Specifically, the controller may use the vehicle dynamic uncertainty as a factor in calculating the uncertainty margin or to adjust the uncertainty margin.

The uncertainty margin may include an added distance behind the calculated location of the designated position of the vehicle system to ensure that the current location of the designated position of the vehicle system may be covered by the uncertainty margin. The uncertainty margin may ensure that there may be an adequate distance behind the designated position of the vehicle system. A supplemental safety margin may be added to the uncertainty margin. The supplemental safety margin may be a distance behind the anticipated location of the designated position. The supplemental safety margin may be a safeguard to ensure that the uncertainty margin may be sufficiently far enough behind the designated position of the vehicle system to accomplish a designated operation, for example a safety operation.

The uncertainty margin may provide a buffer of space to ensure the designated position of the vehicle system, for example the rear end, may be captured by the calculated location of the designated position. The uncertainty margin may be used by the operator and/or control system when making safety related decisions with respect to the designated position of the vehicle system. For example, the uncertainty margin may be used when making a decision about whether another vehicle system may safely pass behind the designated position of the vehicle system. The uncertainty margin may be determined periodically during a trip, for example once every ten seconds. In one example, the uncertainty margin may be determined responsive to an operational or safety command by the operator.

A trailing sensor 150 may be positioned on the trailing vehicle. The trailing sensor may be positioned on another vehicle of the vehicle system, for example any position on the vehicle system that may be behind, in a direction of movement, the leading sensor. In one example, the trailing sensor may be positioned on a powered vehicle of the vehicle system. The trailing sensor may include a navigation system or positioning system, for example GNSS transceiver, another wireless triangulation system, or the like. The trailing sensor may include any of the sensors discussed above with reference to the leading sensor.

The trailing sensor may determine a measured location 170 of the designated position of the vehicle system. In one example, the measured location may be a distance spaced a fixed distance from the designated position, for example 10 feet, 100 feet, 500 feet, or the like. The controller may use information from the trailing sensor, the PVC system, as well as other inputs, to calculate the location of the designated position of the vehicle system. As discussed further below, the other inputs may include route information, vehicle speed, communication data, or the like. In one example, the location may be a single point, however, in other examples, the location may be a range made up of two or more points. The range may be a space between the two or more points, an area that encompasses the two or more points, a volume that encompasses the two or more points, or the like. The trailing sensor may communicate the determined location of the rear end of the vehicle system to the controller of the vehicle system.

In one example, the controller may be at the front end of the vehicle system. The trailing sensor may communicate with the controller on a repeated basis, for example, once per minute, once per two minutes, or the like. In another example, the controller may be at the rear end of the vehicle system. In another example, the rear end and the front end of the vehicle system may both have onboard controllers. There may be instances where the trailing sensor may not be able to communicate with the controller and thus the controller may not be able to calculate the location of the designated position of the vehicle system based on the trailing sensor. When the controller may not receive output from the trailing sensor, the controller may rely on the leading sensor to determine the location of the designated position of the vehicle system. However, when the controller does receive output from the trailing sensor, the controller may determine whether the calculated location of the designated position and the measured location of the designated position determined using the trailing sensor inputs are correlated. The locations may be correlated when the locations are within a threshold distance from one another. The locations being within the threshold distance may indicate that both sensors have determined the designated position to be in a similar general area, and thus may provide a higher confidence of the location of the designated position. When the leading sensor and trailing sensor determined locations are correlated, the controller may use the output from the trailing sensor, the output from the leading sensor, outputs from the PVC system, outputs from crew members, and the like, to determine the location of the designated position of the vehicle system.

The controller may determine a trailing sensor uncertainty 172 behind the measured location to account for potential expected errors in the measurement from the trailing sensor. In one example, the trailing sensor uncertainty behind the measured location may account for communication delays from the trailing sensor to the controller. There may be a delay in the delivery of the output from the trailing sensor to the controller and the controller may factor in this delay when determining the trailing sensor uncertainty. For example, the trailing sensor uncertainty may be changed in a direction opposite of movement, responsive to a greater communication delay. In one example, the trailing sensor uncertainty may be determined by the controller and may factor in a speed of the vehicle system. The speed of the vehicle system may be a current speed of the rear end of the vehicle system, the front end of the vehicle system, an average speed of the vehicle system, or the like.

The controller may multiply the speed of the vehicle system with the communication delay to determine the trailing sensor uncertainty. For example, the communication delay may be two seconds and the controller may multiply the communication delay by the speed of the vehicle system to account for the communication delay and calculate the trailing sensor uncertainty. In one example, when the speed of the vehicle system may be slower, the trailing sensor uncertainty may be smaller. This may be the result of the changes in the measured locations of the designated position changing more rapidly during fast movement, which can result in greater uncertainty in measuring the geographic location of the designated location (when compared with moving more slowly). In one example, the leading sensor data may be stored at the leading portion of the vehicle system with timestamps and the trailing sensor data may be sent to the leading portion of the vehicle system. The trailing sensor data will be received with a delay at the leading portion of the vehicle system, and the delay may be compared to the appropriate leading sensor data based on the timestamps of the data.

In one example, the trailing sensor uncertainty may be a default value that may be determined by the controller based on historical data from the trailing sensor compared with historical data of an actual location of the designated position of the vehicle system. When the historical data from the trailing sensor and the actual location may vary widely or may have large errors associated, the trailing sensor uncertainty may be larger. When the historical data from the trailing sensor and the actual location may vary less widely or may have smaller errors associated, the trailing sensor uncertainty may be smaller.

The controller may determine the trailing sensor uncertainty to factor in errors in the sensor accuracy (e.g., GNSS margin of error), the communication delay, the PVC system, vehicle system operational characteristics, or the like. The trailing sensor uncertainty may represent an error margin in the location of the designated position that is measured using the trailing sensor. This uncertainty margin can indicate various different spaces where the designated position may actually be located (where the measured location is inaccurate or imprecise). In one example, the trailing sensor uncertainty may be one distinct point. In another example, the trailing sensor uncertainty may be two or more points, making up a range of uncertainty. The range of uncertainty may be a space between the two or more points, an area that encompasses the two or more points, a volume that encompasses the two or more points, or the like. The trailing sensor uncertainty may be calculated by the controller and may account for potential errors (e.g., sensor accuracy errors) in the inputs (e.g., the locations measured) from the trailing sensor.

The trailing sensor uncertainty may provide a more conservative estimate for the location of the designated position of the vehicle system. This may be useful when making safety decisions involving the designated position of the vehicle system. The trailing sensor uncertainty may be determined by the controller using the trailing sensor output and multiplying by an uncertainty factor for the output. In one example, the trailing sensor uncertainty factor may be determined by the controller or by machine learning based on historical data or based on a formula. In one example, the trailing sensor uncertainty factor may be a default value. The trailing sensor uncertainty factor may then be added on to the trailing sensor output location, to arrive at the trailing sensor uncertainty point behind the location of the designated position. The trailing sensor uncertainty behind the location of the designated position may provide a location that may be further behind the location of the designated position determined using the trailing sensor.

The trailing sensor uncertainty may be used as a buffer to ensure that designated position of the vehicle system may be captured. In one example, the trailing sensor uncertainty factor for a GNSS location may be about 99.9999999%. In one example, the trailing sensor uncertainty margin may be expressed as a percentage that may be the confidence level of the calculation of the location of the designated position. The trailing sensor uncertainty margin may be determined as an estimated error standard deviation for each geographic location reported. The trailing sensor uncertainty factor may be determined repeatedly during a trip, for example once every minute. In one example, the trailing sensor uncertainty factor may be determined responsive to an operational or safety command by the operator. In one example, the trailing sensor uncertainty factor may be determined each time the trailing sensor outputs data to the controller. Suitable ways to calculate, determine or express the uncertainty factor may include a numerical value, a categorization (high/medium/low, etc.), and the like.

In one example, the controller may compare the uncertainty margin and the trailing sensor uncertainty to determine a verified location uncertainty 180 behind the designated position of the vehicle system. The controller may calculate the verified location uncertainty based on a most conservative position (e.g., the most rearward position, in the direction of travel) possible between the two correlated locations of the designated position, using the leading sensor and the trailing sensor. In the example illustrated in FIG. 1, the trailing sensor uncertainty may be the most conservative position, and thus may be used as the verified location uncertainty. As such, the uncertainty margin may be updated to a new uncertainty margin 162 to align with the verified uncertainty margin. In another example, the uncertainty margin may be the most conservative position and may be used as the verified location uncertainty. In this scenario, the trailing senor uncertainty may be updated based on the verified location uncertainty. In one example, the verified location uncertainty behind the designated position of the vehicle system may be a single point. In one example, the verified location uncertainty behind the designated position may be two or more points.

The verified location uncertainty behind the designated position of the vehicle system may provide a conservative, or worst-case scenario, of where the designated position of the vehicle system may be located. This may help facilitate safety decisions with respect to the designated position of the vehicle system. By using the outputs from multiple sensors, at multiple positions of the vehicle control system, the controller may be able to determine, with greater confidence, the determined location of the designated position of the vehicle system. The verified location uncertainty may be determined repeatedly during a trip, for example once every ten seconds. In one example, the verified location uncertainty may be determined responsive to an operational or safety command by the operator.

Figure 2:
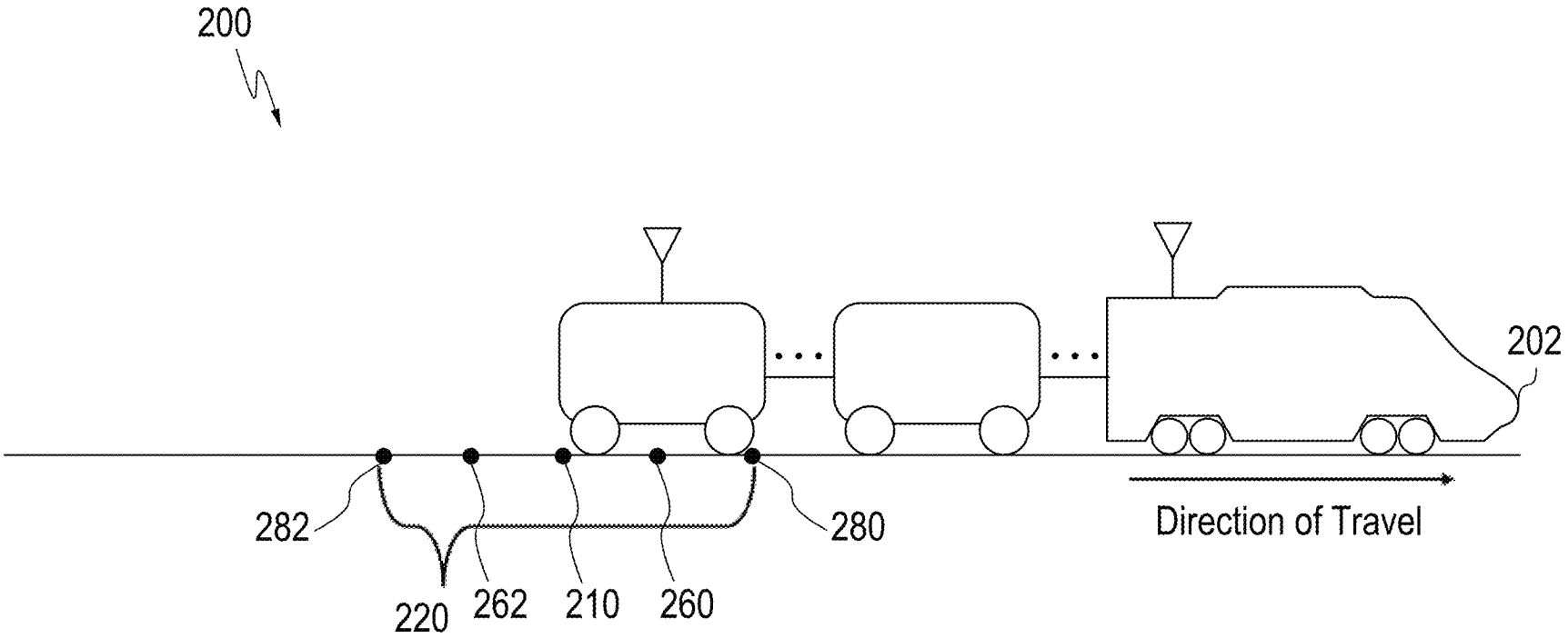
FIG. 2 illustrates one example of a location determining system that can determine a location of a designated position of a vehicle system based on outputs from a leading sensor.

FIG. 2 illustrates one example of a location determining system 200 that can determine a location of a designated position of a vehicle system 202 based on outputs from the leading sensor. FIG. 2 may include substantially similar components (e.g., vehicle system, sensors, controller) as discussed in FIG. 1. For brevity, the components are incorporated into the discussion of FIG. 2. The system of FIG. 2 may primarily use the location information calculated by the controller using the leading sensor, the length of the vehicle system, and the route database. In the example illustrated in FIG. 2, the designated position may be the rear end of the vehicle system, however the designated position may be elsewhere on the vehicle system. The designated position may have an actual location 210. The actual location of the designated position may be the location at which the designated position may actually be located, and which the location determining system may be attempting to ascertain.

The controller may determine a forward location uncertainty 260 of the designated position of the vehicle system and a rearward location uncertainty 262 of the designated position of the vehicle system. The forward location uncertainty of the designate position may be a forward most location, in the direction of travel, of the calculated location of the designated position. The forward location uncertainty may be based on a forward portion of the calculated location of the designated position, with the uncertainty margin included. The rearward location uncertainty may be a rearward most location, in the direction of travel, of the calculated location of the designated position. The rearward location uncertainty may be based on a rearward portion of the calculated location of the designated position, with the uncertainty margin included.

The forward and rearward location uncertainties may be calculated by the controller and may account for potential errors (e.g., sensor accuracy errors) in the inputs (e.g., the locations determined) from the leading sensor. The forward location uncertainty may be based on the accuracy of the GNSS location, which may be 99.9999999%. In one example, the forward location uncertainty margin may be expressed as a percentage that may be the confidence level of the calculation of the location of the designated position. The forward location uncertainty margin may be determined as an estimated error standard deviation for each geographic location reported. In one example, the forward and rearward location uncertainties may be a default value. The default value may be calculated based on historical data indicating an uncertainty of historical locations determined for the designated position of the vehicle system compared with actual locations of the designated position of the vehicle system. The default values of the forward and rearward location uncertainty may be calculated based on a formula derived based on the historical data. In one example, the location uncertainty may be manually input by a crew member of the vehicle system.

The controller may calculate a verified location uncertainty behind 282 the designated position of the vehicle system, as well as a verified location uncertainty ahead 280 of the designated position of the vehicle system. The controller may calculate the verified location uncertainty based on the most conservative position (e.g., the most rearward position, in the direction of travel) possible between the two correlated locations of the designated position, using the leading sensor and the trailing sensor, as discussed above. The verified location uncertainty may incorporate outputs from the trailing sensor to confirm, or deny, the location determined based on the outputs from the leading sensor. For example, the controller may use the verified location uncertainty to determine whether the outputs from the trailing sensor may be within the determined location uncertainty from the leading sensor. When the outputs from the trailing sensor may be within the determined location uncertainty from the leading sensor, the location determining system may have a greater confidence in the location of the designated position, as both sensors may provide a location within a threshold of each other. Said another way, both sensors may provide a location that may be correlated with each other, which may increase a confidence level that locations may be accurate.

A range between the verified location uncertainty behind and the verified location uncertainty ahead may be a first range area 220 in which the designated position of the vehicle system may be located. The first range area may be calculated by the controller based on the inputs from the leading sensor and may be the area that the location determining system calculated that the designated position of the vehicle system to be located. The first range area may be the area that the controller calculates, with uncertainty factored in, that the designated position may be located. The controller may use the first range area as the expected area of the designated position, and the controller may use the first range area in safety decisions or navigational decisions related to the designated position of the vehicle system.

Figure 3:
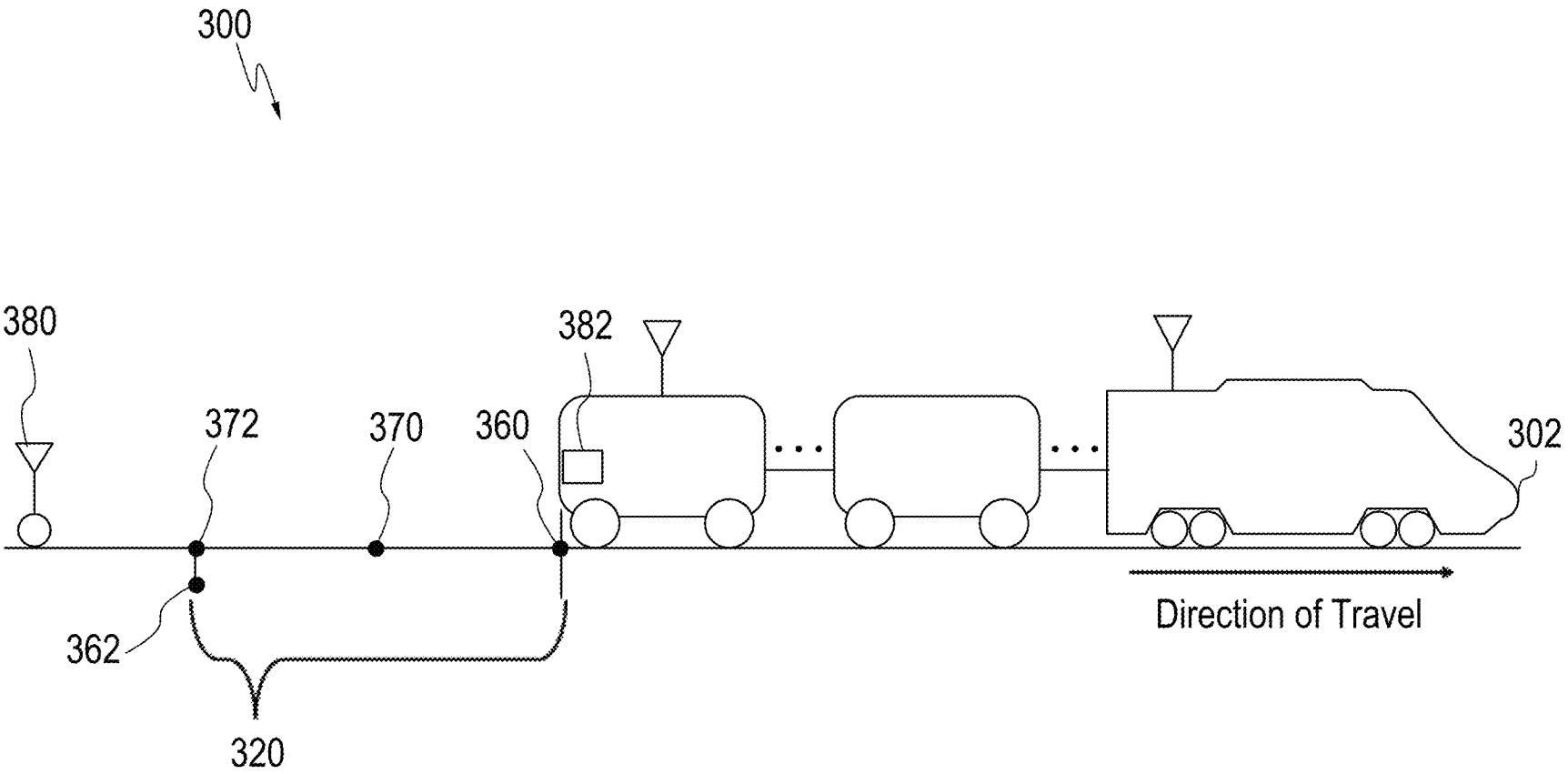
FIG. 3 illustrates one example of a location determining system that can determine a location of a designated position of a vehicle system based on outputs from a trailing sensor.

FIG. 3 illustrates one example of a location determining system 300 that can determine a location of a designated position of a vehicle system 302 based on outputs from the trailing sensor. FIG. 3 may include substantially similar components (e.g., vehicle system, sensors, controller) as discussed in FIG. 1. For brevity, the components are incorporated into the discussion of FIG. 3. The system of FIG. 3 may primarily use the location information calculated by the controller using the trailing sensor. In the example illustrated in FIG. 3, the designated position may be the rear end of the vehicle system, however the designated position may be another portion of the vehicle system. The designated position of vehicle may have a location 370 measured by the trailing sensor. The location measured by the trailing sensor may be a location the trailing sensor may anticipate the designated position of the vehicle system may be located.

The controller may calculate a trailing sensor uncertainty 372 behind the location to account for potential expected errors in the measurement from the trailing sensor, the communication delay, the vehicle speed, and the like, as discussed above. The trailing sensor uncertainty may account for errors in the sensor measurement, communication delays, vehicle speed, and the like. The trailing sensor uncertainty may provide a more conservative estimate for the location of the designated position of the vehicle system.

The controller may determine a verified trailing sensor forward location uncertainty 360 of the designated position of the vehicle system and a verified trailing sensor rearward location uncertainty 362 of the designated position of the vehicle system. The verified trailing sensor forward location uncertainty and the verified trailing sensor forward location uncertainty may be calculated by the controller by incorporating outputs from the leading sensor to confirm, or deny, the location measured by the trailing sensor. For example, the controller may use the verified trailing sensor forward location uncertainty to determine whether the outputs from the leading sensor may be within the determined location uncertainty from the trailing sensor. When the outputs from the leading sensor may be within the determined location uncertainty from the trailing sensor, the location determining system may have a greater confidence in the location of the designated position, as both sensors may provide a location within a threshold of each other. Said another way, both sensors may provide a location that may be correlated with each other, which may increase a confidence level that locations may be accurate.

The verified trailing sensor forward location uncertainty may be a forward most location in which the location determining system may expect the designated position of the vehicle system may be located, based on the trailing sensor output. The verified trailing sensor rearward location uncertainty may a rearward most location in which the location determining system may expect the designated position of the vehicle system may be located, based on the trailing sensor output. The verified trailing sensor forward and rearward location uncertainties may form a range in which the trailing sensor may determine the designated position of the vehicle system may be located. In one example, the verified trailing sensor rearward location uncertainty may be the same as the trailing sensor uncertainty determined discussed above. The controller may determine a second range area 320 between the verified trailing sensor forward location uncertainty and the verified trailing sensor rearward location uncertainty. The second range area may provide an expected range that may include the designated position of the vehicle, as determined by the controller using the trailing sensor output. The second range area may be the area that the controller calculates, with uncertainty factored in, that the designated position may be located. The controller may use the second range area as the expected area of the designated position, and the controller may use the second range area in safety decisions or navigational decisions related to the designated position of the vehicle system.

In one example, the controller may receive multiple outputs of the location of the designated position measured by the trailing sensor, specifically when the vehicle system may be stopped. The controller may average the multiple outputs, as well as average the location uncertainty of the multiple outputs. The controller may use the mean location and the mean location uncertainty to determine the designated position location based on the trailing sensor outputs. In one example, where the vehicle system may be stopped, additional weight may be given to the mean location. For example, where the vehicle system may be stopped and multiple location readings of the trailing sensor indicate the designated position of the vehicle system may be within a certain range, the mean location may be used as a highly weighted factor of the location of the designated position. Additionally, the controller may use the mean location to calculate the space between adjacent vehicles when the vehicle system is stopped. The controller may use this information to validate the vehicle dynamic uncertainty, as discussed above.

The output of the trailing sensor may be compared to a location of a wayside device 380 positioned along the route traveled by the vehicle system as the designated position of the vehicle system may pass the wayside device. The designated position of the vehicle system may include a tag reader 382, for example a radio frequency identification (RFID), that may read a tag or signal from the wayside device. In one example, the wayside device may be a switch in the route traveled. Where the output from the trailing sensor may be determined to be within a predetermined threshold of the wayside device, the controller may place more weight on the output from the trailing sensor. Where the output from the trailing sensor may be outside the predetermined threshold of the wayside device, the controller may place less weight on the output from the trailing sensor.

Figure 4:
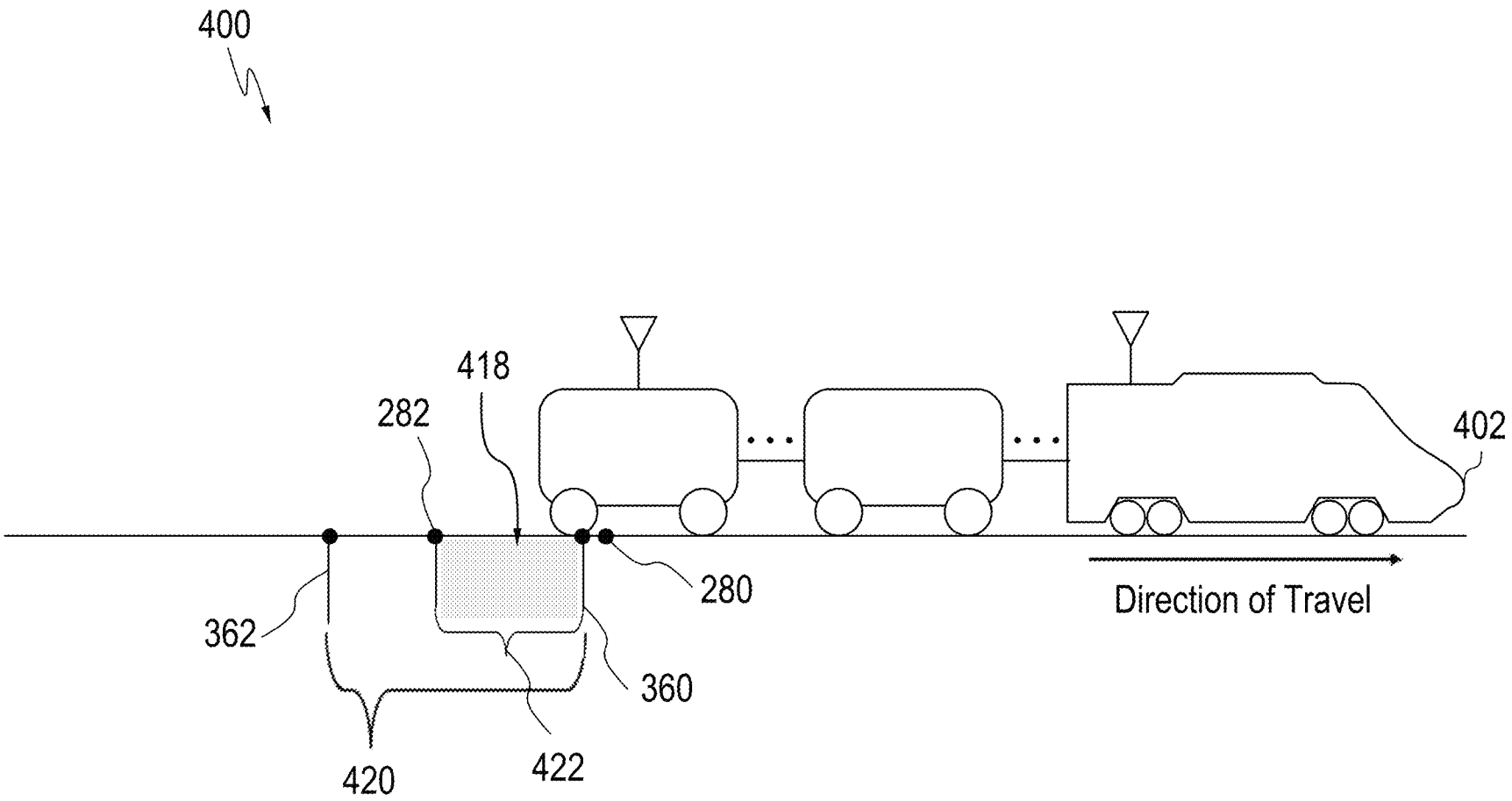
FIG. 4 illustrates one example of a location determining system that can determine a location of a designated position of a vehicle system based on outputs from a leading sensor and a trailing sensor.

FIG. 4 illustrates one example of a location determining system 400 that can determine a location of a designated position of a vehicle system 402 based on outputs from the leading sensor and the trailing sensor. The controller may compare the first range area and the second range area that were determined by the controller. The controller may identify whether an overlap 418 may exist between the first range area and the second range area. The overlap may indicate a higher confidence in the first range area and the second range area, such that certain safety functions may be requested or performed without further input from the operator or crew member. The overlap may indicate a higher confidence because both range areas produced locations that may be correlated with each other.

Where there may be an overlap, the controller may determine a third range area 420 in which the designated position of the vehicle system may be located. The third range area may be based on a rearward most portion 362 of the overlap. In the embodiment illustrated in FIG. 4, the rearward most portion of the overlap may be the trailing sensor rearward location uncertainty. In another example, the rearward most portion of the overlap may be the rearward location uncertainty of the leading sensor. The third range area may be used as a safety uncertainty distance behind the designated position of the vehicle system. The third range area may be used by the system where more conservative decisions need to be made, for example when making a safety decision such as whether another vehicle system may pass behind the designated position of the vehicle system. The third range area may not be associated with a most likely location of the designated position, however, the third range area may provide a most rearward location that the designated position may be located, to factor in a safety uncertainty location.

When there may be an overlap between the first and second range areas, the controller may determine a location of the designated position based on the overlap where the location of the designated position may be a location range 422 most likely associated with the designated position of the vehicle. In the example illustrated in FIG. 4, the location range most likely associated with the designated position of the vehicle may be a location between the trailing sensor forward location uncertainty and the verified location uncertainty behind the designated position of the vehicle system. These locations may be selected as fully overlapping portions of the first and second range areas. In one example, the location of the designated position may be an average of the first range area and the second range area. In another example, the first range area and the second range area may be weighted based on a confidence level associated with the range area. The location of the designated position may be calculated based on the weight of the first range area and the second range area. The location of the designated position may be used for non-safety related purposes, for example displaying on a map where the designated position of the vehicle system may be located, where an accurate estimation may be more valuable than a conservative estimation.

Where there may be an overlap, this may indicate a range in which there may be a higher confidence that the designated position of the vehicle system may be located. The higher confidence may be a result of the multiple sources of input (e.g., at least the leading sensor and the trailing sensor) indicating the designated position of the vehicle system may be located in a same general vicinity. The higher confidence may result in actions being requested or performed without additional input from the operator or the crew of the vehicle system to verify the location of the designated position. For example, safety decisions, such as can another vehicle system pass behind the designated position of the vehicle system, may be made without additional input when there may be the higher confidence level based on the overlap.

Figure 5:
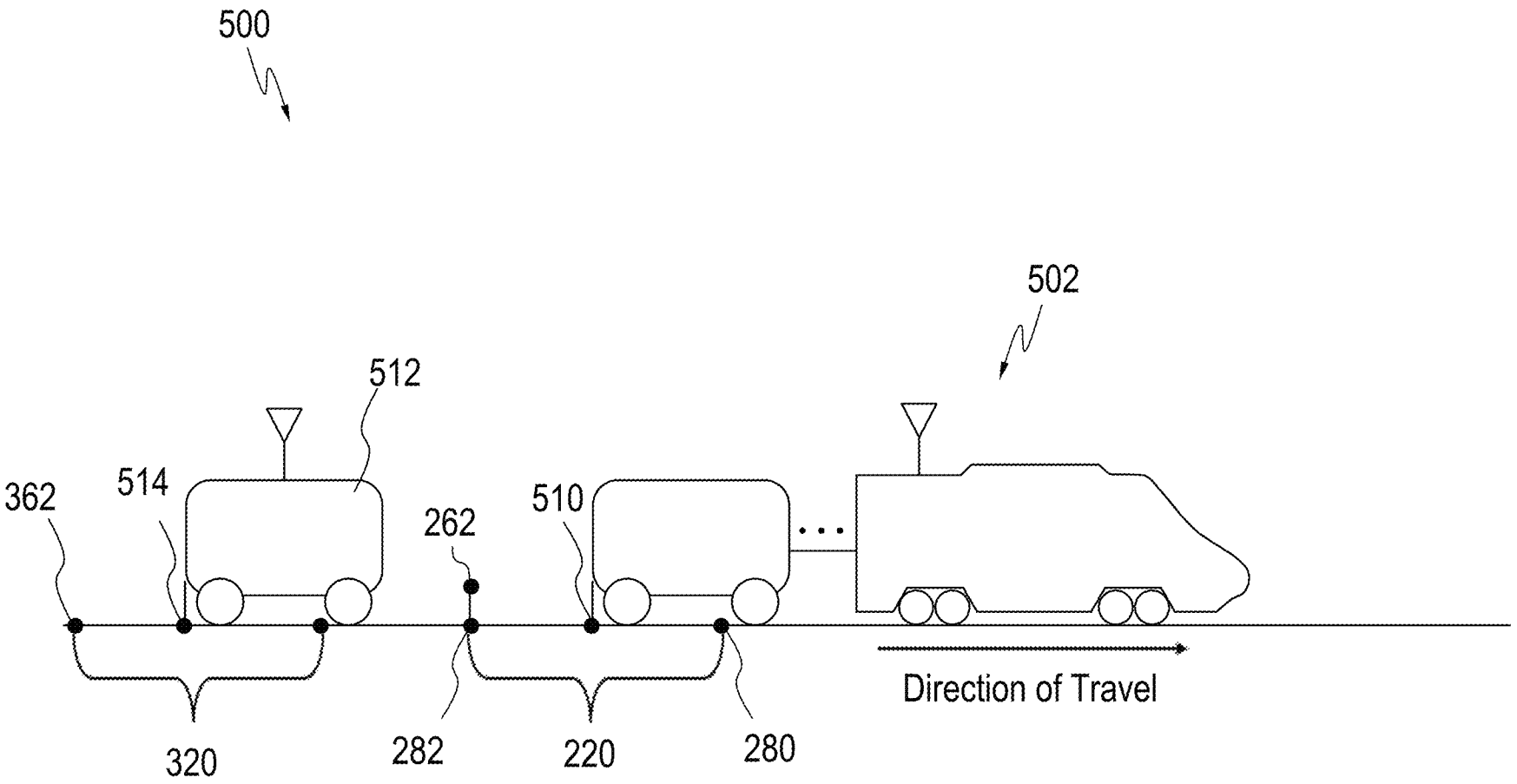
FIG. 5 illustrates one example of a location determining system that can determine a location of a designated position of a vehicle system.

FIG. 5 illustrates one example of a location determining system 500 that can determine a location of a designated position of a vehicle system 502. The designated position (e.g., the rear end position) of the vehicle system may have an actual location 510. The actual location may be the location at which the designated position of the vehicle system may actually be located. The first range area may have a rearward location uncertainty 262 of the designated position of the vehicle system. The second range area 320 may be fully outside the first range area 220 and behind the rearward location uncertainty. In one example, the controller may determine a time at which the first range area and the second range area were calculated, based on a time stamp of the outputs from the leading and trailing sensors, respectively. This may ensure that the first range area and the second range area are being evaluated within a predetermined amount of time of one another. The predetermined amount of time may be between 5 seconds and 5 minutes of the determination of the first range area and the second range area. Determining that the first range area and the second range area are determined within the predetermined amount of time may ensure that the range areas may be predicting the location of the designated position close enough in time and space that the ranges may expected to be correlated with one another.

When the first range area and the second range area do not overlap, the controller may take a responsive action. The first range area and the second range area not overlapping may indicate issues with the vehicle system, for example, lack of vehicle system integrity. The responsive action may be to change operation of the vehicle system by slowing or stopping the vehicle system to prevent damage to the vehicle system or another vehicle system, send a notification to the operator of the vehicle system indicating the potential issue, send a notification to an off-board controller or operator to perform an inspection of the vehicle system or the route, sound an alarm, or the like.

In one example, the controller may use the first range area and disregard the second range area when there may be no overlap. The controller may use the first range area because the leading sensor may be able to provide more frequent communication to the controller, and thus may be more reliable. In one example, the controller may use the second range area and disregard the first range area when there may be no overlap. The controller may slow or stop the vehicle system responsive to no overlap being determined between the first range area and the second range area. The second range area may be determined to be greater than a threshold distance from the first range area. The second range area being greater than the threshold distance from the first range area may indicate that the designated position of the vehicle may no longer be moving with the front end of the vehicle. Where the second range area may be greater than a threshold distance from the first range area, the controller may take a responsive action. The controller may request inspection of a portion of the vehicle system containing the trailing sensor. The inspection may be to determine whether the portion of the vehicle system containing the trailing sensor may have broken away from the remainder of the vehicle system (e.g., a first vehicle 512 separated from the front portion of the vehicle system).

As discussed above, the trailing sensor may need to communicate an output from the designated position 514 (e.g., the rear end) of the vehicle system to the controller, in one example on the front end of the vehicle system. For some vehicle systems, this may be a large distance that may result in a communication delay from the trailing sensor to the controller. As such, in one example, a designated position speed of the vehicle system may be determined and may be multiplied by a designated position communication delay. In one example, a front end speed of the vehicle system may be multiplied by the designated position communication delay. By multiplying the speed by the communication delay, the controller may be able to account for the difference in the location determined and the actual location due to message delay on a moving vehicle system. The designated position communication delay may include the amount of time it may take a message to be relayed from the designated position of the vehicle system to the front end of the vehicle system. The designated position communication delay may be between 0.1 seconds and 5 seconds, in one example. The trailing sensor uncertainty may be added to the produce of the designated position speed and the designated position communication delay to provide the second range area.

Figure 6:
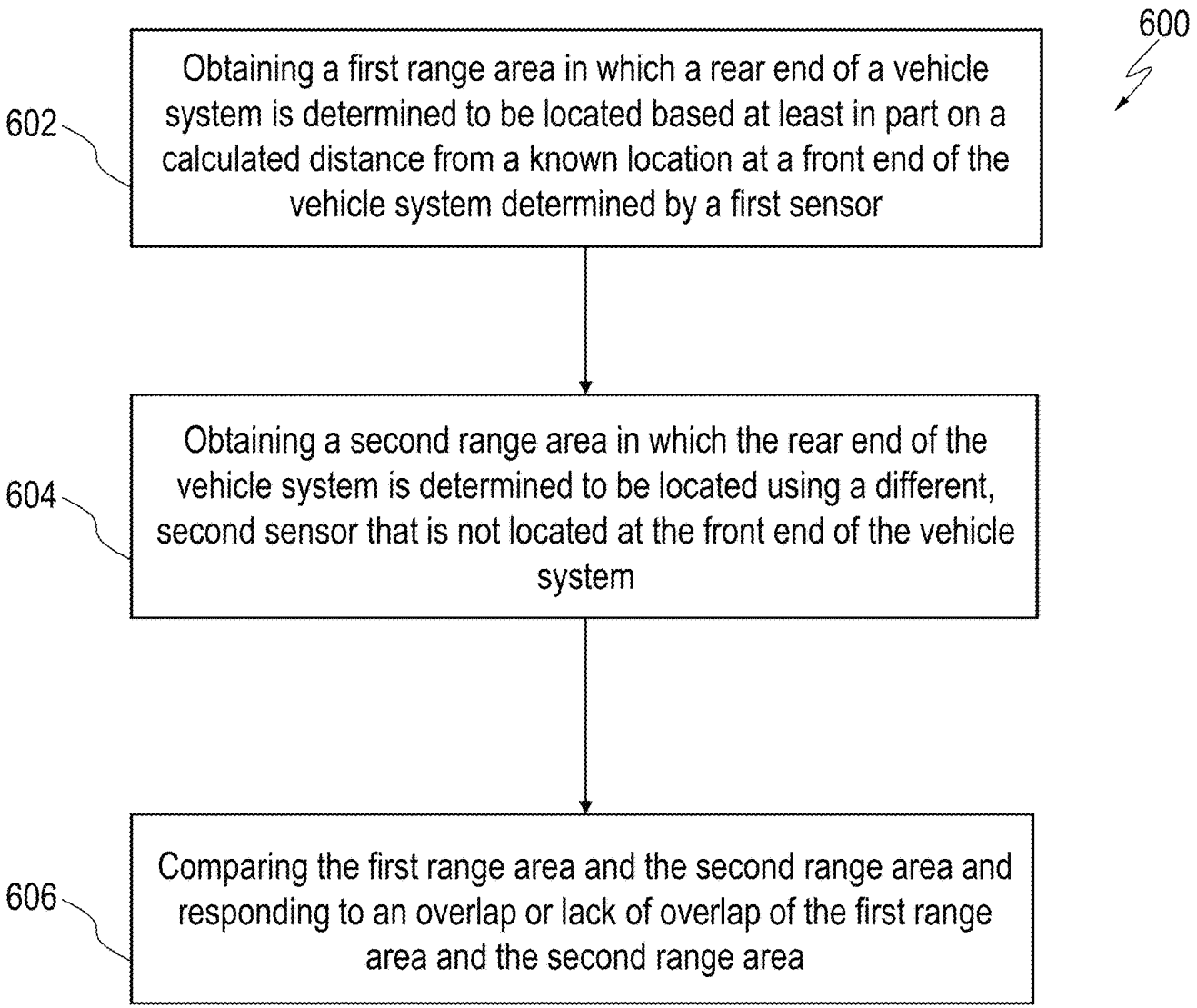
FIG. 6 illustrates one example of a flowchart of a method of determining a location of a designated position of a vehicle system.

FIG. 6 illustrates one example of a flowchart of a method of determining a location of a designated position of a vehicle system.

At step 602, the method may include obtaining a first range area in which a designated position of a vehicle system may be determined to be located based at least in part on a calculated distance from a known location at a front end of the vehicle system determined by a leading sensor. The leading sensor may include a navigation system or positioning system, for example a GNSS, a dead reckoning mechanism using a wheel tachometer or other speed sensor, or the like. The leading sensor may determine a location of the front end of the vehicle system. The location may be determined based on an absolute position or a relative position. The relative position may be determined based on a proximity of the leading sensor to the route, or a portion of the route such as a route block, as discussed above.

At step 604, the method may include obtaining a second range area in which the designated position of the vehicle system is determined to be located using a different, trailing sensor that may not be located at the front end of the vehicle system. The trailing sensor may include a navigation system or positioning system, for example a GNSS, or the like.

At step 606, the method may include comparing the first range area and the second range area and responding to an overlap or lack of overlap of the first range area and the second range area. The overlap may indicate a higher confidence in the first range area and the second range area, such that certain safety functions may be requested or performed without further input from the operator or crew member. Where there may be an overlap, the controller may determine a third range area in which the designated position of the vehicle system may be located. In one example, the third range area may be based on a rearward most portion of the overlap in order to provide a more conservative estimate of the location of the designated position. In another example, the third range area may be an average of the first range area and the second range area, where the third range area may be a most likely range in which the designated position of the vehicle may be located.

The controller may compile the information received by the leading sensor, the trailing sensor, the vehicle system, and the control systems, as well as the determined locations based on those inputs. The controller may implement a machine learning system to evaluate the determined locations over time. Specifically, the controller may categories the inputs and evaluate the determined locations based on the categorized inputs. For example, the controller may evaluate the determined locations based on the vehicle system length, the number of vehicles, the route location, or the like. This may allow the controller to evaluate, using machine learning, the determined locations based on various inputs. As an example, the machine learning system may indicate a greater compression along a given route, leading to a less accurate designated position location. The machine learning system may compensate for the previous errors in future determinations.

As discussed above, the designated position determination and system may operate autonomously without user input. Additionally, the designated position determination system may catalog previously run and collected data. In one embodiment, the designated position determination system may have a local data collection system deployed that may use machine learning to enable derivation-based learning outcomes. The controller may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used for vehicle performance and behavior analytics, and the like.

In one embodiment, the designated position determination system may include a policy engine that may apply one or more policies. These policies may be based at least in part on characteristics of a given item of equipment or environment. With respect to control policies, a neural network can receive input of a number of environmental and task-related parameters. These parameters may include a leading sensor output, a trailing sensor output, a speed of the vehicle system, a length of the vehicle system, a route characteristic, or the like. The neural network can be trained to generate an output based on these inputs, with the output representing an action or sequence of actions that the controller should take to activate or deactivate the converter. During operation of one embodiment, a determination can occur by processing the inputs through the parameters of the neural network to generate a value at the output node designating that action as the desired action. This action may translate into a signal that determines the designated position location of the vehicle system. This may be accomplished via back-propagation, feed forward processes, closed loop feedback, or open loop feedback. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the controller executes that plan to achieve the desired input data to mirror the predicted best outcome scenario. Additionally, the success metric may be a combination of the optimized outcomes, which may be weighed relative to each other.

In one embodiment, a method is provided that may include obtaining a first range area in which a designated position of a vehicle system may be determined to be located based at least in part on a calculated distance from a known location at a front end of the vehicle system that has been determined by a leading sensor. The front end may be relative to a direction of travel. The method may include obtaining a second range area in which the designated position of the vehicle system may be determined to be located using a different, trailing sensor that may be located spaced away from the front end of the vehicle system. The method may include determining a degree of overlap, or lack of overlap, of the first range area and the second range area and responding to a determined degree of overlap.

In one example, the method may include determining the first range area based at least in part on one or more of a length of the vehicle system, a number of vehicles in the vehicle systems, a speed of the vehicle system, a type of vehicle in the vehicle system, or a stretch or compression between vehicles of the vehicle system. The second range area may be determined using a GNSS receiver located closer to the designated position of the vehicle system than the front end of the vehicle system as the trailing sensor.

In one example, the method may include determining that the first range area and the second range area overlap and responding by using a rearward most portion of the overlap as a third range area in which the designated position of the vehicle is determined. The third range area may be used as a safety uncertainty distance behind the designated position of the vehicle system. In another example, the method may include determining that the first range area and the second range area overlap and then determining a location of the designated position based on the overlap between the first range area and the second range area. The location of the designated position may be a location most likely associated with the designated position of the vehicle system.

The first range area may be modified based at least in part on a plurality of vehicles in the vehicle system being in a compression mode. The compression mode may reduce a gap between adjacent vehicles of the plurality of vehicles.

When the first range area and the second range area may not overlap, the method may include changing operation of the vehicle system to slow or stop the vehicle system. When the second range area is greater than a threshold distance from the first range area, the method may include requesting inspection of a portion of the vehicle system containing the trailing sensor. In one example, the trailing sensor may be positioned at a rear end of the vehicle system or in a vehicle in a vehicle group that is furthest from the lead vehicle. In one example, the trailing sensor may be positioned on a powered vehicle of the vehicle system.

The second range area determined by the trailing sensor may be compared to a location of a wayside device that is disposed along a route traveled by the vehicle system as the designated position of the vehicle system passes the wayside device. The method may include confirming that at least one of the first range area or the second range area may be positioned on a track block corresponding to the track block in which the front end of the vehicle system may be located.

In one embodiment, a system is provided that may include a first sensor, a second sensor, and a controller having one or more processors. The first sensor may sense a location of a reference position of a vehicle system. The controller may calculate a first range area in which a designated position of the vehicle system may be determined to be located based at least in part on a calculated distance from the location of the reference position determined by the first sensor. The second sensor may sense a second range area in which the designated position of the vehicle system may be determined to be located. The controller may compare the first range area and the second range area and may respond to an overlap or a lack of overlap of the first range area and the second range area.

In one example, the second sensor may be positioned in a rear end portion of the vehicle system. In one example, the second sensor may be positioned at a wayside device that is disposed along a route of the vehicle system. The controller's one or more processors may determine the first range area based at least in part on one or more of a length of the vehicle system, a number of vehicles in the vehicle system, a speed of the vehicle system, a type of vehicle in the vehicle system, or a stretch or compression between vehicles of the vehicle system. The second range area may be determined using a GNSS receiver as the second sensor.

In one example, when the first range area and the second range area overlap, the controller's one or more processors may determine a third range area in which the designated position of the vehicle system may be determined based on a rearward most portion of the overlap. The third range area may be used as a safety uncertainty distance behind the designated position of the vehicle system. In one example, when the first range area and the second range area overlap, the controller's one or more processors may determine a location of the designated position based on the overlap between the first range area and the second range area. The location of the designated position may be a location most likely associated with the designated position of the vehicle system.

The first range area may be modified based on a plurality of vehicles in the vehicle system being in a compression mode. The compression mode may reduce a gap between adjacent vehicles of the plurality of vehicles. In one example, when the first range area and the second range area do not overlap, a rearward most range of the first range area and the second range area may be used as a location of the designated position of the vehicle system. The rearward most range may be communicated to wayside devices that are disposed along a route being traveled by the vehicle system. In one example, when the first range area and the second range area do not overlap, the controller's one or more processors may change operation of the vehicle system to slow or stop the vehicle system.

In one embodiment, a method is provided that may include sensing a first location of a first vehicle system using a first sensor. The method may include adding a designated distance to the first location to identify a calculated range of potential locations of a designated position of the first vehicle system. The method may include obtaining a sensed location of the designated position of the first vehicle system using a second sensor. The method may include comparing the calculated range of potential locations of the designated position with an uncertainty range of the sensed location of the designated position to determine whether the sensed location of the designated position and the calculated range of potential locations of the designated position overlap or are within a threshold distance of each other. The method may include identifying a safety boundary at or within a rearward most of the calculated range and the uncertainty range responsive to the calculated range and the uncertainty range overlapping each other or being within the threshold distance of each other or identifying the safety boundary at or within the calculated range responsive to the calculated range and the uncertainty range not overlapping and not being within the threshold distance of each other.

In one example, the method may further include slowing or stopping at least a second vehicle system to prevent the at least the second vehicle system from crossing a safety boundary. The method may include modifying one or more of the sensed location of the designated position or the calculated range of the potential locations of the designated position using one or both of a moving speed of the first vehicle system or a route layout responsive to the first location and the sensed location of the designated position not being sensed within a threshold period of time of each other.

The first location may be sensed by identifying a switch in a route traveled by the first vehicle system or by identifying a wayside device disposed along the route. In one example, the first location of the first vehicle system may be sensed using a first GNSS receiver located closer to a front end of the first vehicle system than an opposite end of the first vehicle system as the first sensor. The sensed location of the designated position of the first vehicle system may be sensed using a second GNSS receiver located closer to the opposite end of the first vehicle system as the second sensor. The sensed location of the designated position determined by the second sensor may be compared to a location of a wayside device positioned along a route traveled by the first vehicle system as a designated position of the first vehicle system passes the wayside device.

The method may include calculating the designated distance using one or more of a length of the first vehicle system, a number of vehicles in the first vehicle system, a speed of the first vehicle system, a type of vehicle in the first vehicle system, or a stretch or compression between vehicles of the first vehicle system.

As used herein, an element or step recited in the singular and proceeded with the word "a" or "an" do not exclude the plural of said elements or operations, unless such exclusion is explicitly stated. Furthermore, references to "one embodiment" of the invention do not exclude the existence of additional embodiments that incorporate the recited features. Moreover, unless explicitly stated to the contrary, embodiments "comprising," "comprises," "including," "includes," "having," or "has" an element or a plurality of elements having a particular property may include additional such elements not having that property. In the appended claims, the terms "including" and "in which" are used as the plain-English equivalents of the respective terms "comprising" and "wherein." Moreover, in the following claims, the terms "first," "second," and "third," etc. are used merely as labels, and do not impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function devoid of further structure.

The above description is illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein define the parameters of the inventive subject matter, they are exemplary embodiments. Other embodiments will be apparent to one of ordinary skill in the art upon reviewing the above description.

Use of phrases such as "one or more of . . . and," "one or more of . . . or," "at least one of . . . and," and "at least one of . . . or" are meant to encompass including only a single one of the items used in connection with the phrase, at least one of each one of the items used in connection with the phrase, or multiple ones of any or each of the items used in connection with the phrase. For example, "one or more of A, B, and C," "one or more of A, B, or C," "at least one of A, B, and C," and "at least one of A, B, or C" each can mean (1) at least one A, (2) at least one B, (3) at least one C, (4) at least one A and at least one B, (5) at least one A, at least one B, and at least one C, (6) at least one B and at least one C, or (7) at least one A and at least one C.

What is claim is:

1. A method, comprising:

obtaining a first range area in which a designated position of a vehicle system is determined to be located based at least in part on a calculated distance from a known location at a front end of the vehicle system that has been determined by a leading sensor, where the front end is relative to a direction of travel;

obtaining a second range area in which the designated position of the vehicle system is determined to be located using a different, trailing sensor that is located spaced away from the front end of the vehicle system, the trailing sensor including a global navigation satellite system (GNSS) receiver; and determining a degree of overlap, or lack of overlap, of the first range area and the second range area and responding to a determined degree of overlap.

2. The method of claim 1, further comprising any one of the following:

determining the first range area based at least in part on one or more of a length of the vehicle system, a number of vehicles in the vehicle system, a speed of the vehicle system, a type of vehicle in the vehicle system, or a stretch or compression between vehicles of the vehicle system;

determining the second range area using the GNSS receiver, the GNSS receiver being located closer to the designated position of the vehicle system than the front end of the vehicle system as the trailing sensor;

determining that the first range area and the second range area overlap and responding by using a rearward most portion of the overlap as a third range area in which the designated position of the vehicle system is determined, the third range area configured to be used as a safety uncertainty distance behind the designated position of the vehicle system;

responding to a determined overlap of the first range area and the second range area overlap by determining a location of the designated position based on the overlap between the first range area and the second range area, the location of the designated position configured to be a location most likely associated with the designated position of the vehicle system; or modifying the first range area based at least in part on a plurality of vehicles in the vehicle system being in a compression mode, wherein the compression mode is configured to reduce a gap between adjacent vehicles of the plurality of vehicles.

3. The method of claim 1, further comprising:

determining that the first range area and the second range area do not overlap;

responding by using a rearward most range of the first range area and the second range area as the location for the designated position of the vehicle system; and communicating the rearward most range to a wayside device that is disposed along a route being traveled by the vehicle system.

4. The method of claim 1, further comprising:

determining the first range area and the second range area do not overlap and responding by changing operation of the vehicle system to slow or stop the vehicle system; and determining the second range area is greater than a threshold distance from the first range area by requesting inspection of a portion of the vehicle system containing the trailing sensor.

5. The method of claim 1, wherein the trailing sensor is positioned at a rear end of the vehicle system or in a vehicle in a vehicle group that is furthest from the lead vehicle, or on a powered vehicle of the vehicle system.

6. The method of claim 1, further comprising:

determining the second range area by the trailing sensor by comparing a location of a wayside device positioned along a route traveled by the vehicle system as the designated position of the vehicle system passes the wayside device; or confirming that at least one of the first range area or the second range area are positioned on a track block corresponding to the track block in which the front end of the vehicle system is located.

7. A system, comprising:

a first sensor configured to sense a location of a reference position of a vehicle system;

a controller comprising one or more processors that are configured to calculate a first range area in which a designated position of the vehicle system is determined to be located based at least in part on a calculated distance from the location of the reference position determined by the first sensor;

a second sensor configured to sense a second range area in which the designated position of the vehicle system is determined to be located, wherein the second range area is determined using a global navigation satellite system (GNSS) receiver as the second sensor; and the controller being further configured to compare the first range area and the second range area and respond to an overlap or a lack of overlap of the first range area and the second range area.

8. The system of claim 7, wherein the one controller is further configured to:

determine the first range area based at least in part on one or more of a length of the vehicle system, a number of vehicles in the vehicle system, a speed of the vehicle system, a type of vehicle in the vehicle system, or a stretch or compression between vehicles of the vehicle system.

9. The system of claim 7, wherein when the first range area and the second range area overlap, controller is further configured to:

determine a third range area in which the designated position of the vehicle system is determined based on a rearward most portion of the overlap, the third range area configured to be used as a safety uncertainty distance behind the designated position of the vehicle system; or determine a location of the designated position based on the overlap between the first range area and the second range area, the location of the designated position being a location most likely associated with the designated position of the vehicle system.

10. The system of claim 7, wherein the first range area is modified based on a plurality of vehicles in the vehicle system being in a compression mode, wherein the compression mode is configured to reduce a gap between adjacent vehicles of the plurality of vehicles.

11. The system of claim 7, wherein when the first range area and the second range area do not overlap:

the controller is further configured to change operation of the vehicle system to slow or stop the vehicle system;

the controller is further configured to use a rearward most range of the first range area and the second range area as a location of the designated position of the vehicle system, wherein the rearward most range is communicated to wayside devices along a route being traveled by the vehicle system.

12. A method, comprising:

sensing a first location of a first vehicle system using a first sensor;

adding a designated distance to the first location to identify a calculated range of potential locations of a designated position of the first vehicle system;

obtaining a sensed location of the designated position of the first vehicle system using a second sensor;

comparing the calculated range of potential locations of the designated position with an uncertainty range of the sensed location of the designated position to determine whether the sensed location of the designated position and the calculated range of potential locations of the designated position overlap or are within a threshold distance of each other; and identifying a safety boundary at or within a rearward most of the calculated range and the uncertainty range responsive to the calculated range and the uncertainty range overlapping each other or being within the threshold distance of each other, or identifying the safety boundary at or within the calculated range responsive to the calculated range and the uncertainty range not overlapping and not being within the threshold distance of each other.

13. The method of claim 12, further comprising any one of:

slowing or stopping at least a second vehicle system to prevent the at least the second vehicle system from crossing the safety boundary;

modifying one or more of the sensed location of the designated position or the calculated range of the potential locations of the designated position using one or both of a moving speed of the first vehicle system or a route layout responsive to the first location and the sensed location of the designated position not being sensed within a threshold period of time of each other; or calculating the designated distance using one or more of a length of the first vehicle system, a number of vehicles in the first vehicle system, a speed of the first vehicle system, a type of vehicle in the first vehicle system, or a stretch or compression between vehicles of the first vehicle system.

14. The method of claim 12, wherein the first location is sensed by identifying a switch in a route traveled by the first vehicle system or by identifying a wayside device along the route.

15. The method of claim 12, wherein:

the first location of the first vehicle system is sensed using a first global navigation satellite system (GNSS) receiver located closer to a front end of the first vehicle system than an opposite end of the first vehicle system as the first sensor;

and wherein the sensed location of the designated position of the first vehicle system is:

sensed using a second GNSS receiver located closer to the opposite end of the first vehicle system as the second sensor; or determined by the second sensor is compared to a location of a wayside device positioned along a route traveled by the first vehicle system as a designated position of the first vehicle system passes the wayside device.

* * * * *